US007913862B2

(12) United States Patent
Collins et al.

(10) Patent No.: US 7,913,862 B2
(45) Date of Patent: Mar. 29, 2011

(54) DISPLAY TRAY WITH MOVABLE DIVIDERS

(75) Inventors: Danell M. Collins, Kansas City, KS (US); Craig William Cayce, Kansas City, MO (US); Jimmy J. D. Leeper, Leawood, KS (US); Adam P. Dunn, Lenexa, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 416 days.

(21) Appl. No.: 11/744,507

(22) Filed: May 4, 2007

(65) Prior Publication Data

US 2007/0256997 A1 Nov. 8, 2007

Related U.S. Application Data

(60) Provisional application No. 60/746,440, filed on May 4, 2006.

(51) Int. Cl.
*A47H 1/00* (2006.01)

(52) U.S. Cl. ..... 211/94.01; 211/184

(58) Field of Classification Search ..... 211/94.01, 211/184, 88.01, 87.01, 175, 86.01, 95, 126.1, 211/133.6, 183, 163; 108/60, 61; 220/500; 206/529, 561, 534

See application file for complete search history.

(56) References Cited

U.S. PATENT DOCUMENTS

| | | | | | |
|---|---|---|---|---|---|
| 2,516,122 | A | * | 7/1950 | Hughes | 211/184 |
| 2,532,600 | A | | 12/1950 | Broersma | |
| 2,688,409 | A | * | 9/1954 | Echlin | 211/184 |
| 2,938,634 | A | | 5/1960 | Ganz | |
| 2,982,423 | A | * | 5/1961 | Handler et al. | 211/126.1 |
| 3,285,424 | A | | 11/1966 | Emery | |
| 3,298,538 | A | | 1/1967 | Ganz et al. | |
| 3,339,746 | A | * | 9/1967 | McCabe | 211/43 |
| 3,579,710 | A | * | 5/1971 | Gartzke | 16/93 R |
| 3,612,292 | A | | 10/1971 | Nervig | |
| 3,706,150 | A | | 12/1972 | Greenberger | |
| 3,868,021 | A | * | 2/1975 | Heinrich | 211/184 |
| 3,893,739 | A | * | 7/1975 | Bernard | 312/321.5 |
| 4,552,272 | A | * | 11/1985 | Field | 211/88.01 |
| 4,735,324 | A | * | 4/1988 | Wilcek | 211/184 |
| 4,809,856 | A | * | 3/1989 | Muth | 211/184 |
| 5,082,125 | A | * | 1/1992 | Ninni | 211/184 |
| 5,209,360 | A | * | 5/1993 | Valiulis | 211/184 |
| 5,255,802 | A | * | 10/1993 | Krinke et al. | 211/184 |
| 5,269,600 | A | * | 12/1993 | Arreola et al. | 312/348.3 |
| 6,389,991 | B1 | * | 5/2002 | Morrisson | 108/61 |
| 6,409,028 | B2 | * | 6/2002 | Nickerson | 211/59.3 |
| 6,412,648 | B1 | | 7/2002 | Woolnough et al. | |
| 6,698,603 | B2 | | 3/2004 | Lawson | |
| 7,428,972 | B2 | * | 9/2008 | Warner et al. | 211/59.1 |
| 2003/0189018 | A1 | * | 10/2003 | Hopkins et al. | 211/90.02 |
| 2003/0192842 | A1 | * | 10/2003 | Suttles | 211/87.01 |
| 2006/0096938 | A1 | * | 5/2006 | Kanou | 211/184 |
| 2006/0180561 | A1 | * | 8/2006 | Wisnoski et al. | 211/94.01 |

* cited by examiner

*Primary Examiner* — Jennifer E. Novosad
(74) *Attorney, Agent, or Firm* — Shook, Hardy & Bacon L.L.P.

(57) ABSTRACT

A combination display tray and divider member are disclosed. The display tray includes a rear wall, a support portion depending outwardly therefrom, and a forward lip for retaining items placed on the display tray. The rear wall includes a channel therein for receiving a base portion of the divider member. A divider portion extends outwardly from the base portion member and generally perpendicular to a longitudinal centerline of the channel of the display tray when the base portion of the divider member is slidably received in the channel.

20 Claims, 5 Drawing Sheets

DISPLAY TRAY WITH MOVABLE DIVIDERS

CROSS REFERENCE TO RELATED APPLICATIONS

This application claims priority to commonly owned U.S. provisional application Ser. No. 60/746,440, filed May 4, 2006, which is hereby incorporated by reference in its entirety.

STATEMENT REGARDING FEDERALLY SPONSORED RESEARCH OR DEVELOPMENT

Not applicable.

BACKGROUND

The present invention relates to devices for supporting and displaying items thereon. More particularly, the present invention is directed to a display tray possessing moveable dividers for supporting, organizing and displaying greeting cards in a user-selected manner.

Conventional display shelving has been used for many years in the retail environment to present greeting cards and similar items to customers for purchase. One example of a prior art display shelf 10 is depicted in FIG. 1. The display shelf 10 is substantially formed of plastic material, but may also be formed of metal. The shelf 10 has a back wall 12, a bottom wall 14 and a front wall 16. Adjacent walls are generally perpendicular to one another and connected along adjoining edges thereof. The front wall 16 of the prior art display shelf 10 generally possesses a height sufficient to perform a couple of functions. First, the front wall 16 helps prevent the cards from sliding off the front edge of the bottom wall 14. Additionally, the front wall 16 acts to retain the cards in the pocket created by the wall such that cards placed therein cannot fall forward.

Despite the widespread use of conventional display shelving, it has a few drawbacks. For instance, with the display shelf 10, in order for the front wall 16 to retain the cards in the display shelf, the front wall must be of a substantial height to prevent cards from falling over the top of the front wall. Unfortunately, the front wall 16 also obstructs viewing of the front of the card located on the display shelf 10, such that the potential purchaser has to remove the card from the shelf in order to substantially fully view the front of the card. In connection with the display shelf 10, the prior art made use of divider clips 18 that would clip along the upper edge of the front wall 16 and could be slidably moved there along to accommodate cards of varying widths. The divider clips 18 were generally plastic in nature and adequately performed the function of separating the cards. However, the divider clips 18 could be easily removed by patrons and were often subject to breakage at the point where the clips 18 attached with the shelf front wall 16.

BRIEF SUMMARY OF INVENTION

Various embodiments of a combination display tray and divider member are provided for improving the accessibility and viewing of display items, such as greeting cards. The display tray is generally longitudinal in nature and has a generally J-shaped cross section. The display tray includes a rear wall and a dependant support shelf portion with a retaining lip at a forward edge to prevent cards from sliding off of the support shelf. The rear wall includes an integrated channel or rail component configured to permit the coupling of individual divider members with the rear wall of the display tray. The divider members are configured to have a portion thereof received in the channel component such that the channel permits sliding movement of the divider along the longitudinal axis or centerline of the display tray to permit adjustment for cards of various widths while preventing transverse or outward movement of the divider away from the rear wall of the display tray.

In one aspect, the dividers generally include a first planar section that is slidably received in the channel of the display tray and a second planar section that extends outwardly from and generally perpendicular to the first planar section that is received in the channel. The second planar section can be referred to as an extension portion or a divider portion as it also extends generally perpendicularly outward from the rear wall of the divider tray and is oriented in a transverse orientation to divide adjacent cards received in the support shelf of the divider tray. The divider member may also include a third generally planar section that is coupled with an outer edge of the second planar or divider section and is generally perpendicular thereto such that the third planer section is generally parallel to the first planar section received in the channel. The third planar section may be referred to as a retention member as it prevents cards received in the display tray from falling forward off the display tray during use.

Additional advantages and features of the invention will be set forth in part in a description which follows, and in part will become apparent to those skilled in the art upon examination of the following, or may be learned by practice of the invention.

BRIEF DESCRIPTION OF SEVERAL VIEWS OF THE DRAWINGS

The features of the invention noted above are explained in more detail with more reference to the embodiment illustrated in the attached drawing figures, in which like reference numerals denote like elements, in which FIGS. 2-10 illustrate various embodiments of the present invention, and in which:

FIG. 2 is a fragmentary perspective view of a one embodiment of a display tray of the present invention having two versions of a divider member of the present invention coupled therewith;

FIG. 3 is a fragmentary front side elevational view of the display tray and dividers of FIG. 2 with a portion of the display tray cut away for clarity;

FIG. 4 is a cross sectional view of the display tray and divider of FIG. 2 taken along the line 4-4;

FIG. 5 is a perspective view of one embodiment of a divider member of the present invention;

FIG. 6 is a fragmentary perspective view of another embodiment of a display tray of the present invention having an additional version of a divider member of the present invention coupled therewith;

FIG. 7 is a front side elevational view of the divider member of FIG. 6;

FIG. 8 is a perspective view of the divider member of FIG. 6;

FIG. 9 is a right side elevational view of the divider member of FIG. 6;

FIG. 10 is a right side elevational view of the display tray and divider of FIG. 6.

DETAILED DESCRIPTION OF THE INVENTION

Figure 2:
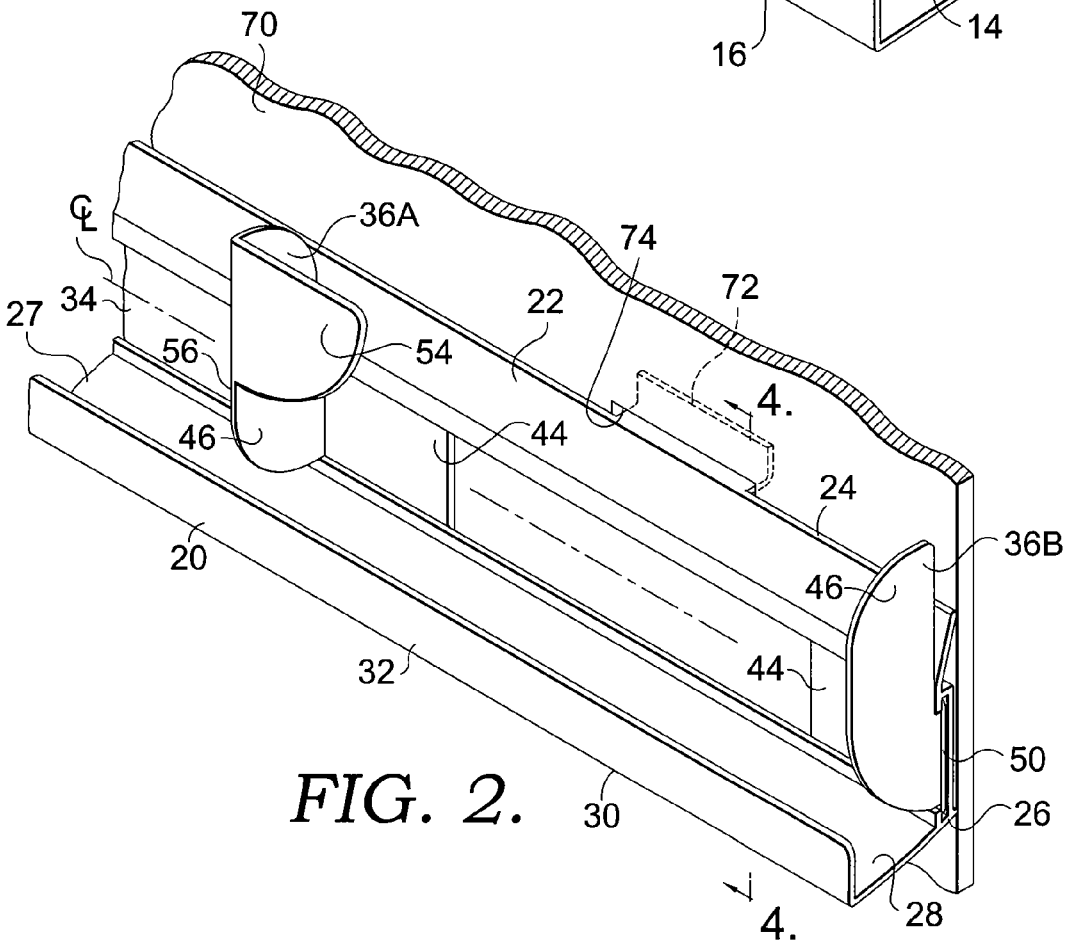
Figure 4:
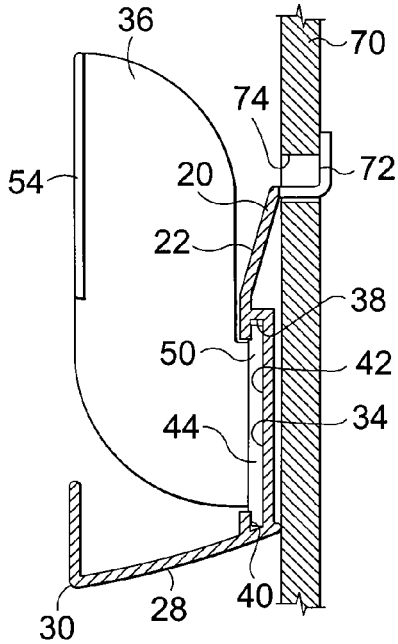

Referring now to the drawings in more detail and initially to FIG. 2, one embodiment of a display tray of the present invention is disclosed and is generally designated by reference numeral 20. The display tray has a rear wall 22 that is generally vertical in nature. The rear wall 22 has an upper edge 24 and a lower edge 26. Depending outwardly from the rear wall 22 adjacent its lower edge 26, is a support shelf portion 27 forming a bottom wall 28. The bottom wall 28 may be generally perpendicular to the rear wall 22 or alternatively, as illustrated in FIG. 4, the bottom wall 28 can slope downwardly away from the rear wall 22. Depending upwardly from a forward edge 30 of the bottom wall 28 is a forward wall or lip 32 generally parallel to the rear wall 22.

The rear wall 22 includes a longitudinally aligned channel 34 therein for receiving a portion of a divider member 36. As best illustrated in FIG. 4, the channel 34 includes an upper groove 38 and a lower groove 40. The upper groove 38 is generally in the shape of an upside down U while the lower groove 40 is generally in the shape of a U. The grooves 38, 40 are opposite and spaced apart from one another by a back portion 42 of the channel 34. Further, the grooves 38, 40 are preferably coplanar. The channel 34 has a longitudinal axis or centerline CL designated in FIG. 2.

Figure 1:
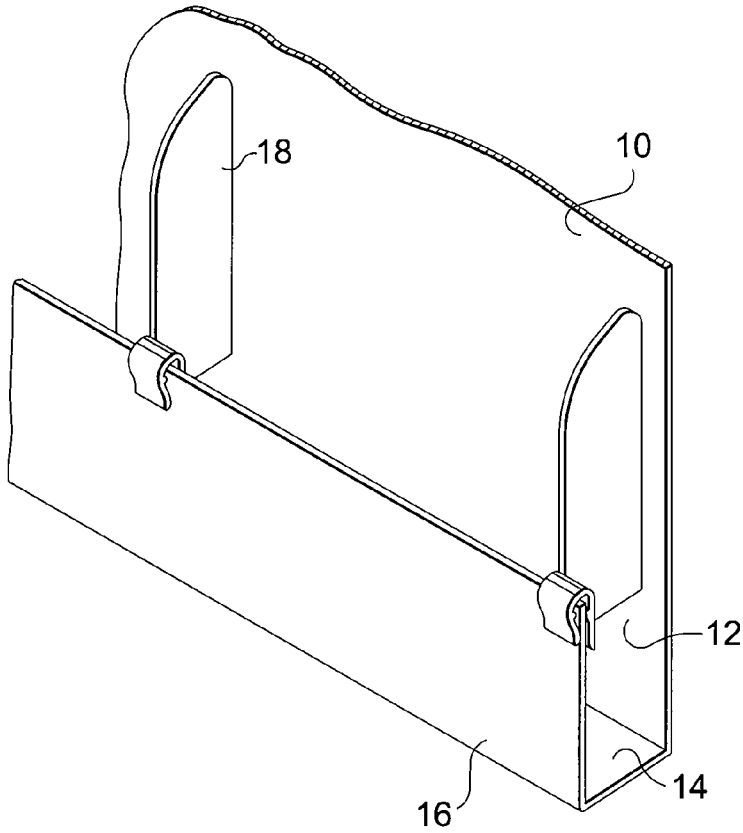
FIG. 1. (PRIOR ART)
FIG. 1 is a fragmentary perspective view of a prior art display shelf having prior art divider clips coupled thereto.

Various embodiments of the divider of the present invention are illustrated in FIG. 2. In particular, one of the embodiments, referenced by numeral 36B, discloses a divider 36 whose main purpose is to separate adjacent stacks of cards that are placed in the display tray 20 of the present invention or to act as an end cap to the display tray 20. Another embodiment of the divider, referenced by numeral 36A, performs the additional function of retaining the cards in the display tray 20 during use. Both embodiments of the divider 36 include a base or first planar portion 44 that is slidably received in the channel 34 to couple the divider 36 with the display tray 20. Both embodiments of the divider 36 also include a generally planar second or divider portion 46. The divider portion 46 is coupled with the first planar portion 44 along a section of a rear edge 48 of the divider portion 46. While the divider portion 46 is preferably coupled with the first planar portion 44 along one of its side edges 50, the divider portion 46 could be coupled along the front face 52 of the first planar portion 44. It should also be understood that the first planar portion 44 may be curved or bowed away from a flat plane to match any degree of bowing of the channel 34 of the display tray 20 in which the first planar portion 44 is received. As can also be appreciated, the surface area of contact between the first planar portion 44 and the grooves 38, 40 of the channel 34 is larger than with the prior art display shelf 10 and divider clips 18 illustrated in FIG. 1, leading to a more structurally sound design to reduce breakage when a user pulls or otherwise induces a force on the divider 36.

The embodiment of the divider 36 identified by numeral 36A also includes a planar third or retainer portion 54. The retainer portion 54 is preferably coupled with the divider portion along a front edge 56 of the divider portion 46 and is preferably generally perpendicular thereto such that the retainer portion 54 is generally parallel to both the first portion 44 and to the longitudinal centerline CL of the channel 34 of the display tray 20 when the first portion 44 is received within the channel 34.

Figure 3:
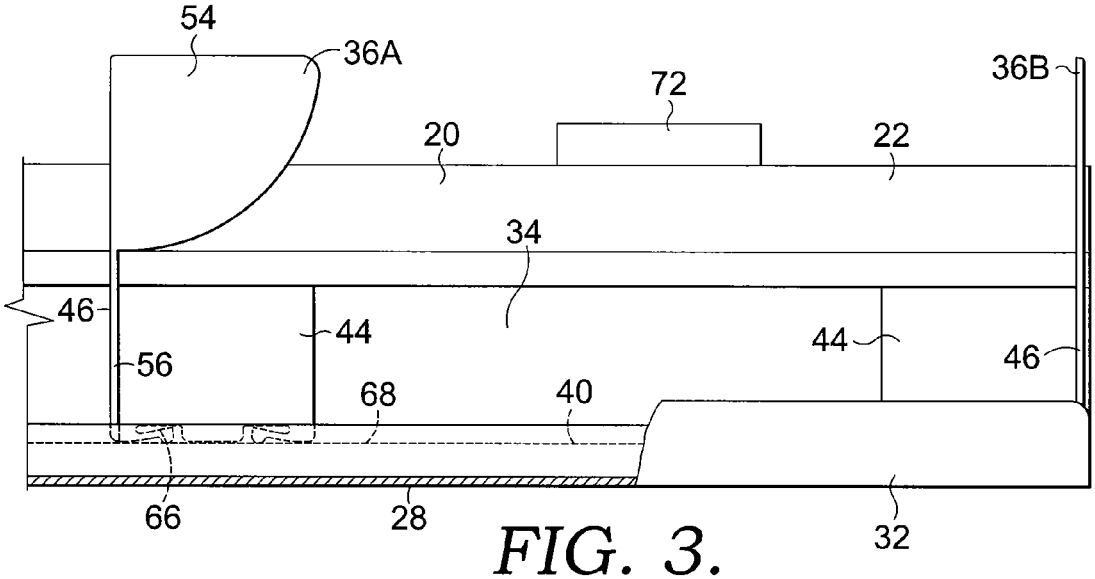
Figure 5:
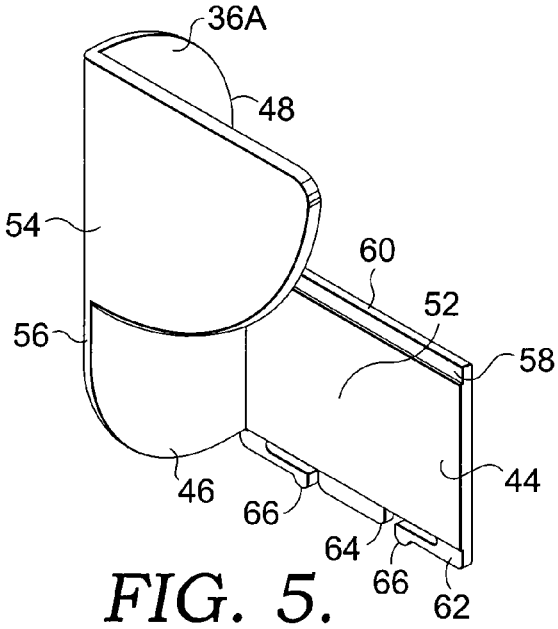
Figure 6:
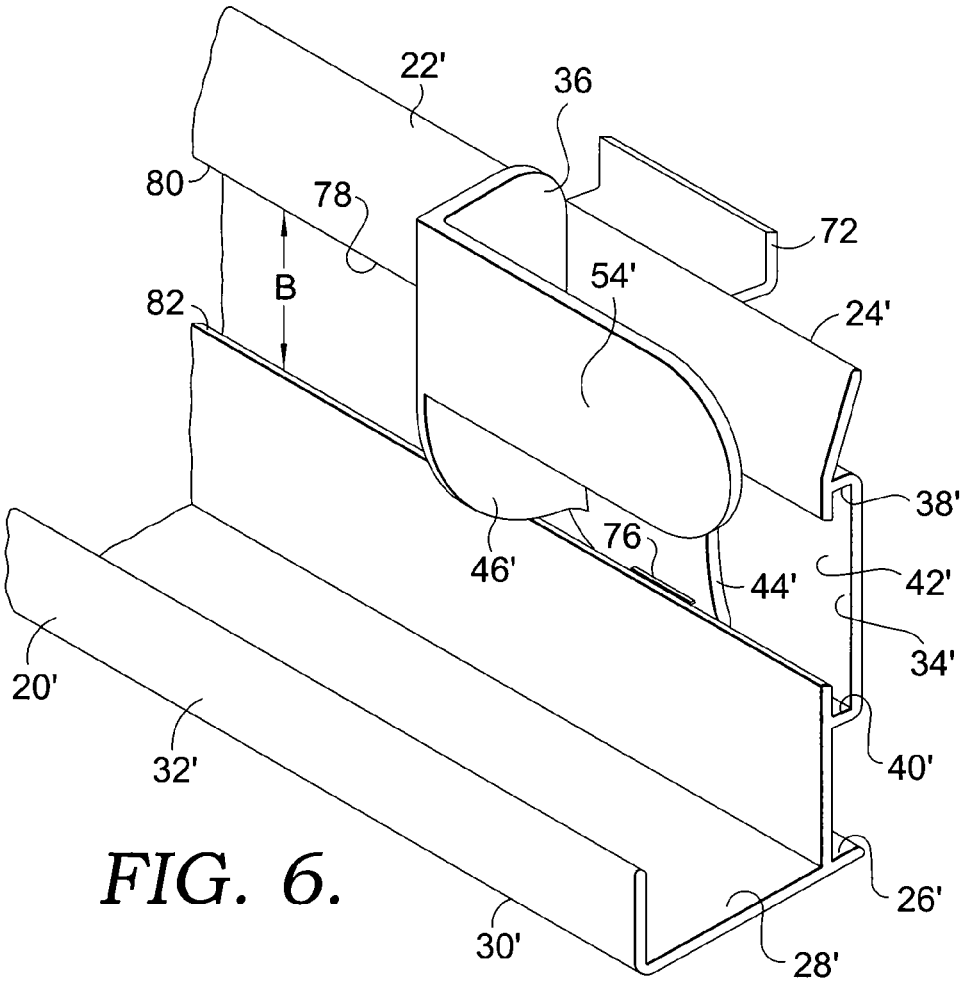

The first portion 44 of the divider 36, as best illustrated in FIG. 5, preferably includes an upper rabbit 58 along the upper edge 60 and a lower rabbit 62 along the bottom or lower edge 64. The rabbits 58, 62, as illustrated in FIG. 4, are received in the upper and lower grooves 38, 40, respectively, of the channel 34. The first portion 44 also includes a pair of fingers 66 which extend downwardly from the bottom edge 64 of the first member 44. The fingers 66 are deflected upwardly, as illustrated in FIG. 3, when the divider member 36 is coupled with the display tray 20 and, more particularly, when the first planar portion 44 of the divider 36 is received in the channel 34 of the rear wall 22. The fingers 66 engage the bottom 68 of the groove 40. The natural resiliency of the fingers 66 creates a spring like effect to bias the divider 36 upwardly such that accidental lateral movement of the divider 36 in the channel 34 is discouraged.

In use, the display tray 20 is coupled with a fixture or a panel of a fixture 70 such that the display tray hangs downwardly therefrom, as illustrated in FIGS. 2 and 4. The connection method disclosed preferably includes a catch flange 72 that depends rearwardly from the upper edge 24 of the rear wall 22. The flange 72 is generally L-shaped and it is received in an aperture 74 in the fixture or panel of the fixture 70. The user then couples a desired number of divider members 36 with the display tray 20 by inserting the base or first portion 44 of the respective divider 36 in an end of the channel 34 and sliding them longitudinally there along.

Preferably, the entire display tray 20 is formed of an extruded plastic that can be clear, opaque or semi-transparent. Similarly, the dividers 36 are preferably formed as an integral piece of plastic. The dividers 36 are preferably transparent such that a user may see the face of the card received in the display tray 20 through the retainer member 54. Similarly, while the front wall 32 of the display tray 20 is significantly shorter than the front wall 16 of the prior art display shelf 10 (as it is not required to retain the cards in the display tray by itself), making the display tray 20 transparent provides that the user can see even the bottom portion of the face of the card through the front wall 32.

Turning now to FIGS. 6-11, a second embodiment of the display tray of the present invention is illustrated. Additionally, a third embodiment of a divider of the present invention is disclosed. For these alternate embodiments, like elements will be denoted by the same numeral given to the similar elements discussed above in the previous embodiments; however, where the element differs slightly, the altered element will be indicated by the presence of a prime mark after the numeral.

The divider tray 20' of the second embodiment also has a rear wall 22', a bottom wall 28' and a front wall 32'. As best illustrated when comparing FIGS. 4 and 10, the channel 34' is further up the rear wall 22' away from the bottom wall 28' than in the first embodiment. In this embodiment, the channel 34' is also deeper than in the prior embodiment. The depth of the channel 34' is greater than the thickness of the first planar portion 44' of the divider 36'.

Figure 9:
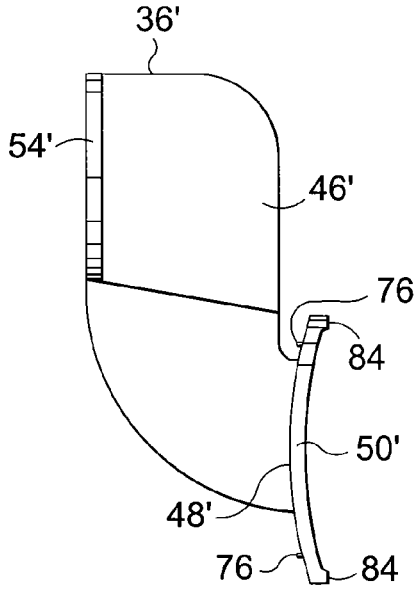
Figure 10:
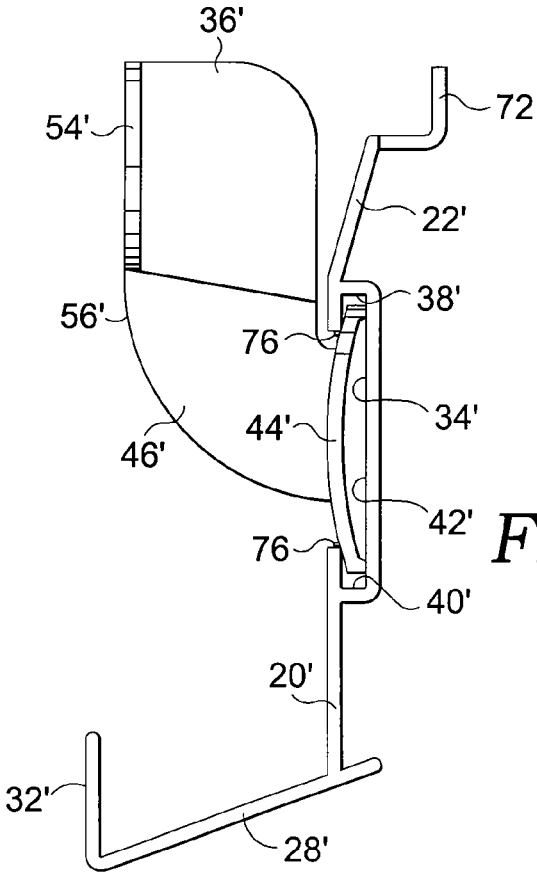

As best illustrated in FIGS. 9 and 10, the first planar portion 44' is bowed outwardly, as opposed to being preferably flat like the particular embodiment of the first planar portion 44 of the embodiments depicted in FIGS. 2-5. The bowed nature of the first planar portion 44' is beneficial in retaining the divider 36' in the channel 34' as discussed in greater detail below. The front face 52' of the first planar portion 44' also includes a pair of generally parallel ridges 76 extending outwardly therefrom. The ridges 76 assist with maintaining the divider 36' in the generally upright use position illustrated in FIG. 6 once the divider 36' is fully received in the channel 34' of the display tray 20'. Unlike the previous dividers 36A, 36B which must be slid into the channel 34 from an end of the display tray 20, the embodiment of the divider 36' depicted in FIGS. 6-10 is designed so that it may be placed into the channel 34' at any desired location. This is accomplished by a unique "twist in" feature discussed below.

Figure 7:
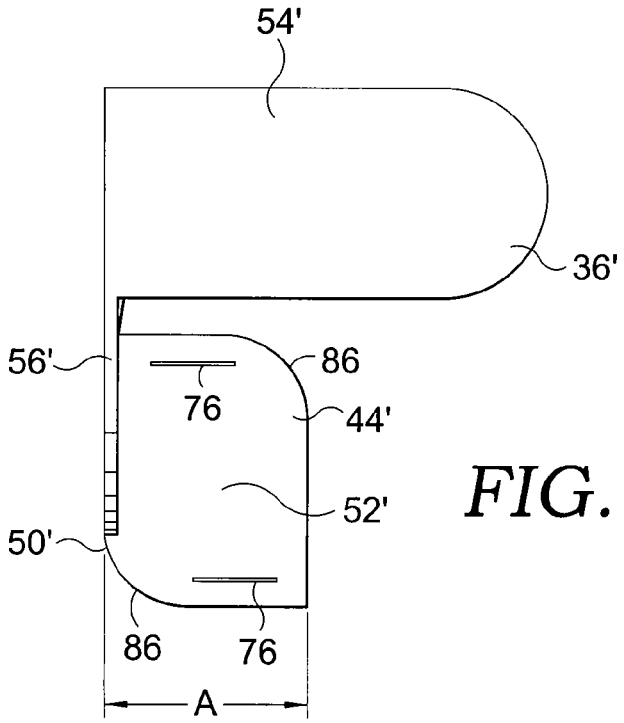
Figure 8:
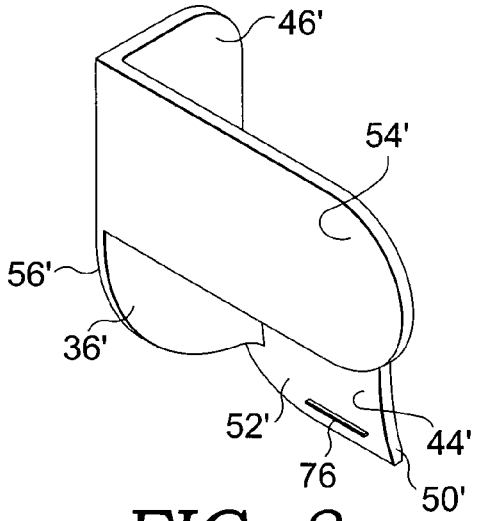

As best illustrated in FIG. 7, the first planar portion 44' has a width dimension identified by reference letter A. The channel 34' has an opening 78 in the rear wall 24' into which access to the channel 34' is provided. The opening 78 is defined by an upper edge of the channel 80 and a lower edge of the channel 82. The distance between the upper edge 80 and the lower edge 82 of the opening 78 into the channel 34' defines a height dimension identified in FIG. 6 by reference letter B. To permit the dividers 36' to be coupled with the channel 34' at desired locations there along, the width dimension A of the first planar portion 44' is sized to be slightly less than the height dimension B of the opening 78 for the channel 34'.

Figure 11:
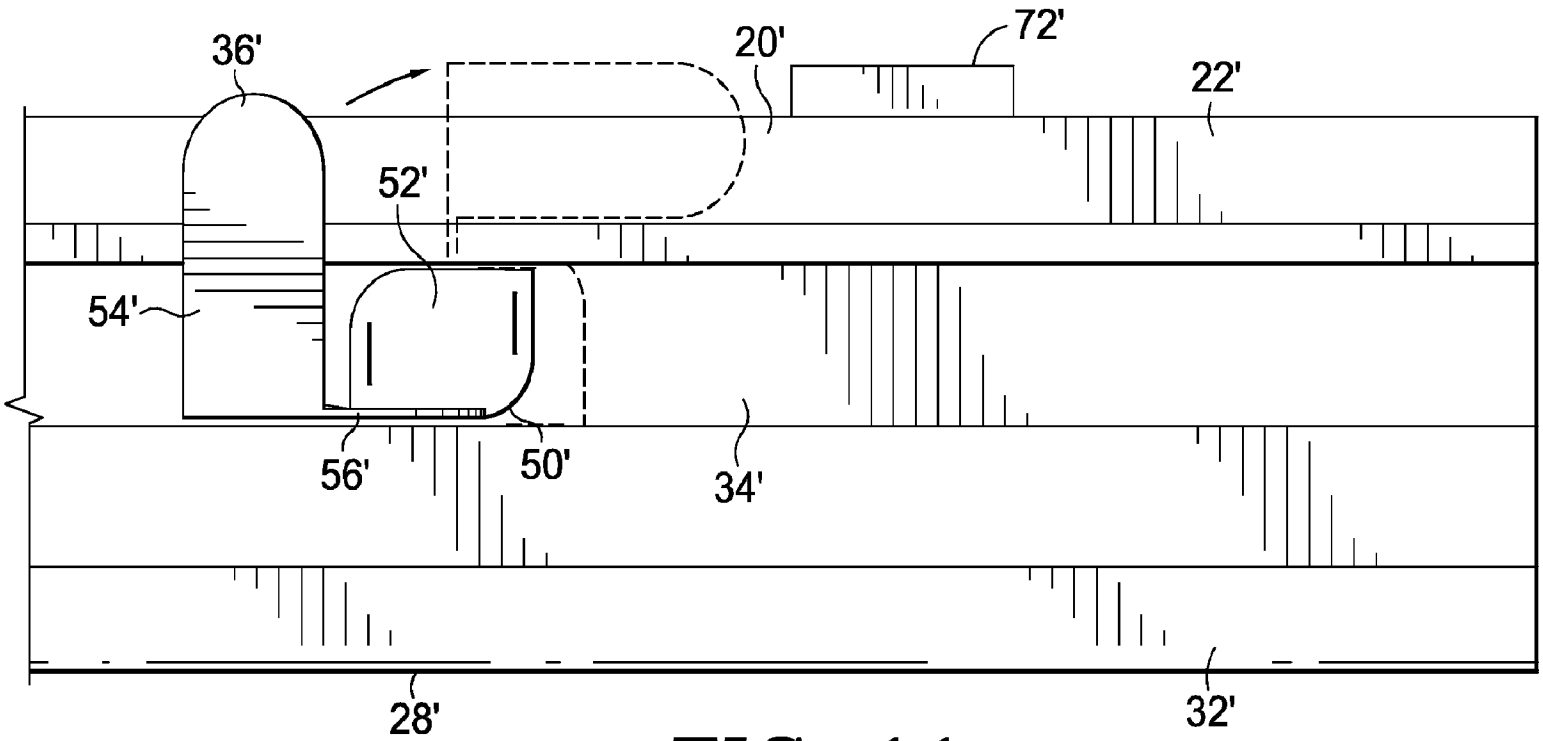
FIG. 11 is a fragmentary front side elevational view of the display tray and divider member of FIG. 6 with the divider member oriented in an insertion position and having a portion thereof positioned in the channel of the display tray prior to rotation to a use position.

To couple a divider 36' with the channel 34' at a desired location, the user orients a divider 36' such that the second planar member 46' is generally horizontal and is parallel to the lower edge 82 of the opening 78 of the channel 34', as illustrated in FIG. 11. This orientation is achieved by rotating the divider member 36' from its use position, illustrated in FIG. 7, 90 degrees counterclockwise to an insertion position, illustrated in FIG. 11. In the insertion position, the width dimension A of the first planar portion 44' is aligned with the height dimension B of the opening 78. The first planar portion 44' can then be inserted into the channel 34' until feet 84 of the first planar portion 44' abut the back portion 42' of the channel 34'. The user then rotates the divider 36' 90 degrees clockwise in the direction of the arrow in FIG. 11, which puts the divider 36' in the use position illustrated in FIGS. 6 and 10 and in dashed lines in FIG. 11. The user may then adjust the location of the divider 36' with respect to the display tray 20' by sliding the divider 36' in the channel 34' through lateral movement. As mentioned above, the ridges 76 cooperate with the upper and lower edges 80, 82 of the opening 78 to assist with maintaining the divider 36' in the upright use position. Opposed rounded corners 86 of the first planar portion 44' assist with allowing the divider 36' to be rotated between the insertion and use positions. The bowed nature of first planar portion 44' provides a compression fit with the channel 34' when the divider 36' is received therein in the use position. The grooves 38', 40' and the bow of the first planar portion 44' are slightly deflected when the divider 36' is received in the channel 34' in the use position. This deflection and the natural resiliency of the material from which the tray 20' and divider 36' are formed biases the divider 36' into a frictional engagement with the channel 34'.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A combination display tray and divider for displaying items contained therein, the combination comprising:

a display tray having a rear wall and a support shelf portion depending outwardly from the rear wall, wherein the support shelf portion includes a forward lip for retaining items placed on the support shelf portion, wherein the rear wall includes a channel positioned longitudinally therein, wherein the channel has an upper groove and a lower groove, wherein the groves are spaced apart from each other a first height dimension, wherein the channel has an opening of a second height dimension; and a divider member for coupling with the display tray, the divider member having a base portion sized for receipt in the channel of the display tray and a generally planar divider portion extending outwardly from and generally perpendicular to the base portion, wherein the base portion has a third height dimension and a first width dimension, wherein the first width dimension of the base portion is slightly less than the second height dimension of the opening, wherein the third height dimension of the base portion is less than the first height dimension of the channel and greater than the second height dimension of the opening, wherein the base portion may be removed from in the channel in a sideways orientation, wherein the base portion is retained in the channel in an upright orientation, wherein the base portion is rotatable in the channel between the sideways orientation and the upright orientation, and whereby the divider portion extends outwardly and generally perpendicular to a longitudinal centerline of the channel of the display tray when the base portion of the divider member is slidably received in the channel.

2. The apparatus of claim 1, wherein the divider member further includes a retainer portion, wherein the retainer portion is generally planar in nature and extends outwardly from the divider portion such that the retainer portion is generally parallel to the longitudinal centerline of the channel of the display tray when the base portion of the divider member is slidably received in the channel.

3. The apparatus of claim 1, wherein the support shelf portion of the display tray includes a bottom wall interconnecting the rear wall with the forward lip of the display tray, the bottom wall having a downward slope moving from the rear wall to the forward lip.

4. The apparatus of claim 1, wherein at least the display tray is formed of extruded plastic.

5. The apparatus of claim 1, wherein the channel of the rear wall is formed by opposed upper and lower grooves aligned with one another and a back plane portion spanning between and spacing apart the upper and lower groves.

6. The apparatus of claim 1, wherein the base portion of the divider member is generally non-planar and is bowed outwardly from a rear of the channel, whereby the bowed shape of the base portion of the divider member causes the base portion of the divider member to cooperate with the channel of the display tray when the base portion of the divider member is positioned therein to create a friction fit relationship therebetween to deter accidental movement of the divider member along the channel.

7. The apparatus of claim 6, wherein the base portion of the divider member further includes a pair of opposed rounded corners, wherein the opposed rounded corners permit the base portion to be rotated in the channel from the sideways orientation to the upright orientation while in the channel, whereby the outwardly bowed base portion of the divider member comes into contact with the opposed upper and lower grooves in the channel that are aligned with one another and is slightly compressed to create a friction fit relationship therebetween.

8. The apparatus of claim 6, wherein the base portion includes a pair of generally parallel ridges extending outwardly from a front face of the base portion, wherein the ridges cooperate with the opening of the channel to assist with maintaining the base portion of the divider member in the upright orientation.

9. The apparatus of claim 1, wherein the base portion of the divider member includes a pair of opposed rounded corners, wherein the opposed rounded corners permit the base portion to be rotated from the sideways orientation to the upright orientation while in the channel.

10. The apparatus of claim 1, wherein the divider portion further includes a generally planar retainer portion extending outwardly from and generally perpendicular to the divider portion, wherein the base, divider, and retainer portions are each in a generally vertical plane, wherein the retainer portion is parallel to the base portion, and wherein the retainer portion has a longitudinal axis that is parallel to the channel.

11. The apparatus of claim 10, wherein the base portion has first and second side edges, wherein the base portion is coupled with the divider portion along one of the base portion's side edges, wherein the retainer portion has first and second side edges, and wherein the retainer portion is coupled with the divider portion along one of the retainer portion's side edges.

12. A combination display tray and divider for displaying items contained therein, the combination comprising:

a display tray having a rear wall and a support shelf portion depending outwardly from the rear wall, wherein the support shelf portion includes a forward lip for retaining items placed on the support shelf portion, and wherein the rear wall includes a channel positioned longitudinally therein; and a divider member for coupling with the display tray, the divider member having a base portion sized for receipt in the channel of the display tray at any point along a length of the channel in a sideways orientation and rotatable to an upright orientation, a generally planar divider portion extending outwardly from and generally perpendicular to the base portion, and a generally planar retainer portion extending outwardly from and generally perpendicular to the divider portion, wherein the base, divider, and retainer portions are each in a generally vertical plane, wherein the retainer portion is parallel to the base portion, and wherein the retainer portion has a longitudinal axis that is parallel to the channel.

13. The apparatus of claim 12, wherein the divider portion has a rear edge and a front edge, wherein the divider portion is coupled with the base portion along the divider portion's rear edge, and wherein the divider portion is coupled with the retainer portion along the divider portion's front edge.

14. The apparatus of claim 13, wherein the base portion has first and second side edges and wherein the base portion is coupled with the divider portion along one of the base portion's side edges.

15. The apparatus of claim 13, wherein the retainer portion has first and second side edges and wherein the retainer portion is coupled with the divider portion along one of the retainer portion's side edges.

16. The apparatus of claim 13, wherein the base portion has first and second side edges, wherein the base portion is coupled with the divider portion along one of the base portion's side edges, wherein the retainer portion has first and second side edges, and wherein the retainer portion is coupled with the divider portion along one of the retainer portion's side edges.

17. The apparatus of claim 12, wherein the channel has an upper groove and a lower groove, wherein the groves are spaced apart from each other a first height dimension, wherein the channel has an opening of a second height dimension, wherein the base portion has a third height dimension and a first width dimension, wherein the first width dimension of the base portion is slightly less than the second height dimension of the opening, wherein the third height dimension of the base portion is less than the first height dimension of the channel and greater than the second height dimension of the opening, whereby the base portion may be removed from in the channel in the sideways orientation, and whereby the base portion is retained in the channel in the upright orientation.

18. The apparatus of claim 17, wherein the base portion of the divider member includes a pair of opposed rounded corners and wherein the opposed rounded corners permit the base portion to be rotated from the sideways orientation to the upright orientation.

19. The apparatus of claim 18, wherein the divider portion has a rear edge and a front edge, wherein the divider portion is coupled with the base portion along the divider portion's rear edge, and wherein the divider portion is coupled with the retainer portion along the divider portion's front edge.

20. The apparatus of claim 19, wherein the base portion has first and second side edges, wherein the base portion is coupled with the divider portion along one of the base portion's side edges, wherein the retainer portion has first and second side edges, and wherein the retainer portion is coupled with the divider portion along one of the retainer portion's side edges.

* * * * *